US005473994A

United States Patent [19]

Foley et al.

[11] Patent Number: 5,473,994

[45] Date of Patent: Dec. 12, 1995

[54] WORK STATION DESK MODULE AND SYSTEM WITH CABLING MANAGEMENT

[75] Inventors: Dennis Foley, Holland; Donald A. Shepherd, Spring Lake, both of Mich.

[73] Assignee: Herman Miller, Inc., Zeeland, Mich.

[21] Appl. No.: 923,010

[22] Filed: Jul. 30, 1992

Related U.S. Application Data

[63] Continuation of Ser. No. 675,535, Mar. 25, 1991, abandoned.

[51] Int. Cl.[6] ..... A47B 35/00

[52] U.S. Cl. ..... 108/50; 312/194

[58] Field of Search ..... 108/50; 312/265.6, 312/223.6, 194, 114

[56] References Cited

U.S. PATENT DOCUMENTS

| | | | |
|---|---|---|---|
| 4,094,561 | 6/1978 | Wolff et al. | 312/223 |
| 4,323,291 | 4/1982 | Ball | 312/196 X |
| 4,646,211 | 2/1987 | Gallant et al. | 312/223 |
| 4,748,205 | 5/1998 | Kelley | 108/50 |
| 4,762,072 | 8/1988 | Boundy et al. | 108/50 |
| 4,974,915 | 12/1990 | Bussard | 108/50 X |
| 5,024,167 | 6/1991 | Hayward | 108/50 |
| 5,103,741 | 4/1992 | Grund et al. | 108/50 |

FOREIGN PATENT DOCUMENTS

| | | | |
|---|---|---|---|
| 6707 | 12/1979 | European Pat. Off. | 108/50 |
| 3438650 | 4/1986 | German Dem. Rep. | 312/223 |

*Primary Examiner*—Stephen C. Pellegrino
*Assistant Examiner*—M. Peffley
*Attorney, Agent, or Firm*—Willian Brinks Hofer Gilson & Lione

[57] ABSTRACT

A work station particularly adapted for use in a uniform open floor plan. The work station has a horizontal work surface having a front edge and a rear edge, a support member for supporting the horizontal work surface, a first trough located in an area beneath the horizontal work surface, and a second trough at a location displaced vertically below the first trough whereby the first and the second troughs define separate substantially horizontal passageways for the laying-in of cabling. In a further aspect, there is provided an office furniture system comprising a plurality of like work station modules aligned along a linearly extending course, each work station module occupying substantially the same area. Each work station module comprises a closed side along the linearly extending course, an open side opposite the closed side, a horizontal work surface, a support member connected to and supporting the horizontal work surface, a first trough parallel to the linearly extending course, a second trough at a location displaced vertically below the first trough and parallel to the linearly extending course so that the first and the second troughs define separate substantially horizontal passageways for electrical, communications, and data cables and the like.

6 Claims, 2 Drawing Sheets

WORK STATION DESK MODULE AND SYSTEM WITH CABLING MANAGEMENT

This application is a continuation, of application Ser. No. 07/575,535 filed Mar. 25, 1991, now abandoned.

BACKGROUND OF THE INVENTION

The present invention relates to office work stations and the systems in which they are employed. In particular the invention relates to an efficient office work station desk module and system having cabling management features that provide for flexibility and reconfigurability in office work space arrangement.

Modern office floor plan design includes several different floor plan arrangements of which one of the most popular and important is the uniform open floor plan. The uniform open floor plan is characterized by the arrangement of work stations with one work station per office worker in an open area (without walls) of a building and further in which the work stations are arranged in a regular or uniform pattern of rows or columns (also referred to herein as "courses") in which each work station occupies the same or substantially the same area. In addition, in the uniform open floor plan design the arrangement of cabinets, work surfaces, shelves and the like may be the same or mirror images of one another from one work station to the next. The advantages of the uniform open floor plan arrangement is that it minimizes area, it is relatively easy to design, and it can be assembled of like components. However, the uniform open floor plan design may have disadvantages associated therewith such as a lack of privacy, both visual and auditory, and a perception of being cramped or crowded.

A further disadvantage of a uniform open floor plan design relates to the difficulty in rearranging the design occasioned for example by the need to move a worker from one location to another in the office. Existing furniture and office components designed specifically for the uniform open floor plan design are relatively difficult to rearrange or reconfigure. For example, in some existing office floor plan arrangements, each office worker is provided with or is served by a combination of two types of furniture or other office equipment. The first type includes components that will follow or be moved with the worker if the worker is relocated to another location. Such components or equipment may include the worker's computer, chair, and files. The other type of equipment includes components or furniture that will stay in place in the uniform open floor arrangement to be used by another subsequent worker. These latter components include for example the desk, filing cabinet, and shelving. These two types of furniture or equipment tend to become intermingled so that when it is desired to relocate a worker, for example, the worker's desk must be emptied, the worker's drawers and shelves must be cleared, and the worker's computer must be disconnected. These operations may take considerable time and effort thereby substantially increasing the burden involved in relocating an office worker. This situation becomes especially difficult in modern offices in which each worker has electrical, data, and communications equipment.

One approach that has been developed to address the previously mentioned problem of a lack of privacy in an open floor plan design is to provide partition walls between each work station. Partition walls used in open floor plan designs come in various types and provide for varying degrees of privacy. Some types of partition walls are intended for use with free standing furniture. Other types of partition walls may provide for the support of work surfaces, cabinets, shelving, and the like. Some partition walls have even been adapted to provide for the inclusion of cables therethrough for the distribution of electrical power to work stations, as well as data and telephone communications.

Although the use of partition walls may alleviate to some extent the lack of privacy in a uniform open floor plan arrangement, partition walls may exacerbate the problem associated with relocating a worker in the uniform office floor plan. Once the electrical, data, and communications cabling for an office worker is placed in the partition walls, access thereto is limited and moving an office worker can require disconnection of the cabling serving that worker from the electrical, data, and telephone cabling in the partition wall. If the partition walls are also used to support cabinets, shelving, or work surfaces, these become relatively permanent parts of the uniform open floor plan arrangement and must be emptied of the worker's files, books, manuals, etc. when the worker is moved to another location. Another disadvantage of existing privacy partition walls is that their capacity for cabling is limited and that modern electrical, data, and communications needs of many office workers can exceed the capacity of the partition walls to provide adequate service.

The aforementioned constraints or drawbacks are especially significant in contemporary offices that attempt to be competitive by following management theories that demand a flexible, adaptable and reconfigurable staff. According to such management approaches, it is desirable to bring together or assemble staffs on a project by project basis. Each project or part of a project may be of only a limited duration to concentrate on a specific task or tasks. Management techniques such as these require that office staffing be readily expanded and contracted. This in turn requires that the office workers and their work stations should be movable with a minimum of effort. Existing office systems and office furniture, especially the systems designed for the uniform open floor plan, have not typically provided this capability.

Another consideration to be taken into account in the modern open floor plan design relates to efficient use of the floor space. Because of high rents in prime office buildings, it is desirable to minimize the space occupied by each individual office worker while at the same time providing the office worker with an efficient work area afforded with ample space and at least a perception of ample privacy.

SUMMARY OF THE INVENTION

According to the present invention, there is provided a work station module particularly adapted for use with a uniform open floor plan in which individual work stations are arranged in rows along a linearly extending course. The work station module has a horizontal work surface having a front edge and a rear edge, a support member for supporting the horizontal work surface, a first trough located in an area beneath the horizontal work surface, and a second trough at a location displaced vertically below the first trough whereby the first and the second troughs define separate substantially horizontal passageways for the laying-in of cabling.

According to a further aspect of the present invention, there is provided an office furniture system comprising a plurality of like work station modules each aligned along a linearly extending course. Each work station module occupies substantially the same area and comprises an open side permitting access therewithin, a closed side along the linearly extending course and opposite the open side, a horizontal work surface, a support member connected to and supporting the horizontal work surface, a first trough in an area beneath the work surface and parallel to the linearly extending course, a second trough in the area beneath the work surface but at a location displaced vertically below the first trough and also parallel to the linearly extending course so that the first and the second troughs define separate substantially horizontal passageways for electrical, communications, and data cables and the like.

For purposes of this application, "like" work station modules include work stations that are identical to each other, substantially identical to each other, are mirror images or substantially mirror images of each other, or include similar components susceptible to arrangement and/or connection in a like manner. "Like" work stations generally occupy an area of uniform area and shape, or near uniform area or shape, or vary by standardized increments (e.g. six, twelve, eighteen inches). Like dimensions of work station modules allow rows of modules immediately adjacent to each other to generally include a like number of work stations along a linearly extending course.

In this specification and appended claims, "cabling" includes any type of wiring, leads, connector, lines, fibers, or the like used for electrical, communications, or data transmissions or distribution.

DETAILED DESCRIPTION OF THE PRESENTLY PREFERRED EMBODIMENTS

Figure 1:
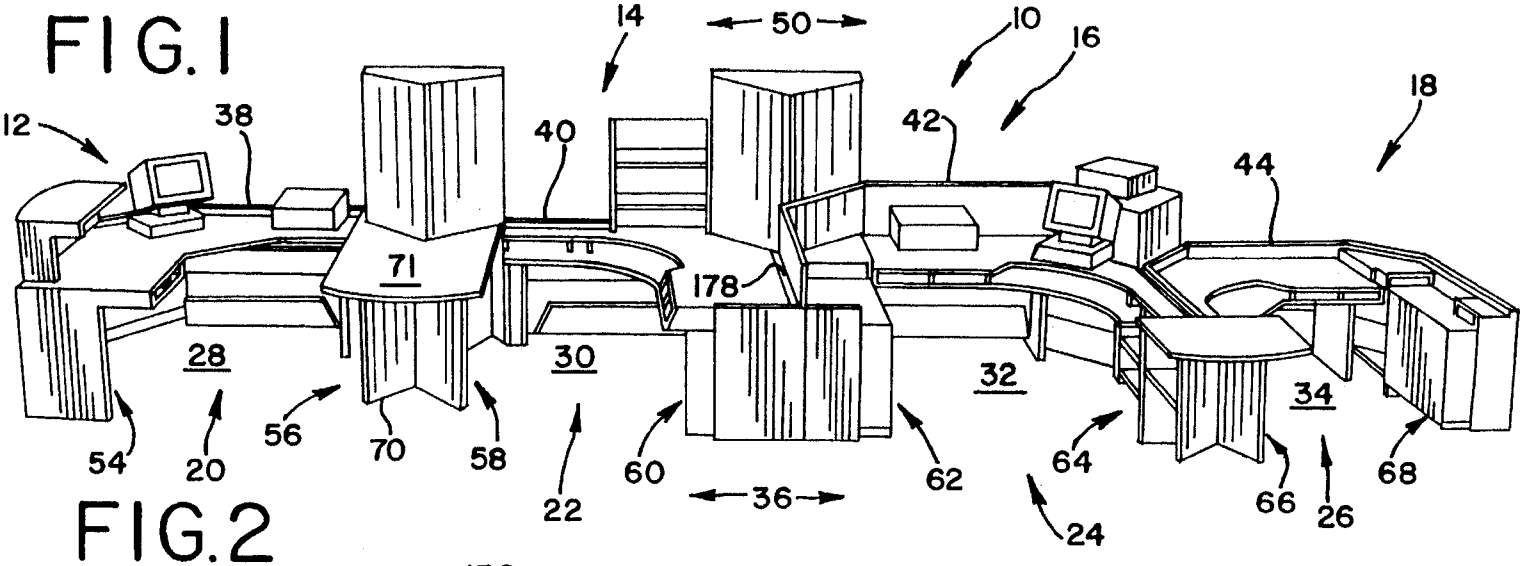
FIG. 1 is a perspective view of a plurality of work stations embodying aspects of one or more embodiments of the present invention.

Referring to FIG. 1, there is depicted a row 10 of like work station modules 12, 14, 16, and 18. The work station modules are uniform as to size and relative dimensions and are arranged so that each work station module has an open side, for instance sides 20, 22, 24, and 26, respectively facing the same general direction to enable access to an interior area, 28, 30, 32, and 34 of each work station in the row 10 from an aisle 36. Each work station has a closed side, i.e. sides 38, 40, 42, and 44, respectively, opposite the open sides 20, 22, 24, and 26, respectively, and which may include work surfaces, cabinets, cabling management channels, and the like. In this embodiment, these closed sides are aligned in a linear row 50. It should be understood that an office plan may include various rows or courses each having various numbers of like work stations and that although a linear arrangement is depicted, arrangements having other configurations, such as right angle corners may also be provided.

Each work station may also include two additional closed sides, i.e., 54, 56, 58, 60, 62, 64, 66, and 68 that are orthogonal in direction to the first closed sides and connected thereto. In a preferred embodiment, adjacent additional closed sides, e.g. 56 and 58, 60 and 62, 64 and 66, may be directly adjacent each other and may share structural components. For example, return support 70 and return work surface 71 may be shared between work stations 20 and 22 forming part of each and usable by persons working at either. Alternatively, the additional closed sides between two work stations may be formed by separate components for each, such as shown between work stations 22 and 24. It is also possible to utilize a combination of shared and discreet components, e.g. between work stations 24 and 26.

Also in a preferred embodiment, a row of similar work stations (not shown) may be arranged immediately adjacent to this row 10 of work stations along the closed sides thereof so that each work station in the second row of similar work stations has a closed side immediately adjacent to the closed side of the first row of work stations and an open side permitting access therein from an aisle to which the open side faces.

Figure 2:
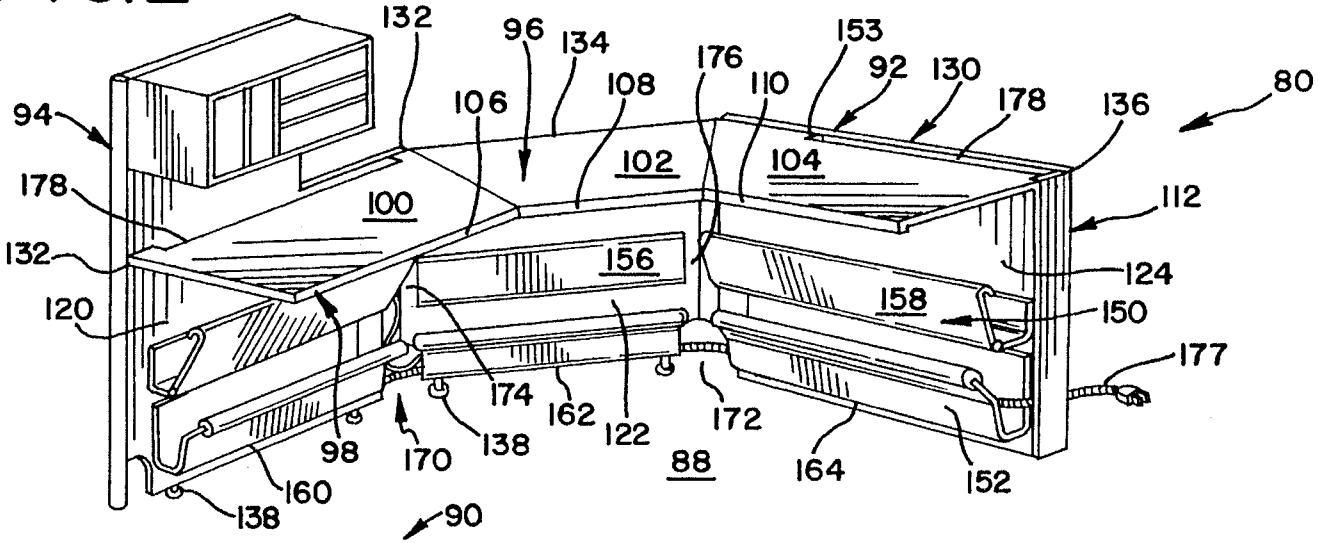
FIG. 2 is a perspective view of a single work station embodying aspects of the present invention.

Referring to FIG. 2, there is depicted a portion of a single work station module 80 of the presently preferred embodiment. This work station module 80 is similar to the work station modules, 20, 22, 24, and 26 of FIG. 1. The work station module 80 includes an area 88 defined by or enclosed within the work station 80 to be occupied by a worker. The work station module 80 of FIG. 2 includes an open side 90 which may open to an aisle (not shown). A closed side 92 is opposite the open side 90 and another closed side 94 is orthogonal and connects to the closed side 92.

The work station module 80 includes a horizontal work surface 96 having a front edge 98 to which a worker can have access while occupying the area 88 defined by or enclosed within the work station 80. In a preferred embodiment, the horizontal work surface 96 comprises three sections 100, 102 and 104 with sections 100 and 104 oriented substantially orthogonally to each other and section 102 connecting sections 100 and 104 and forming an oblique angle with each. The front edge 98 comprises sections 106, 108, and 110 corresponding to surface sections 100, 102, and 104. In this embodiment, the work surface segment 104 is parallel to and may comprise part of the closed side of the work station module.

The work station module 80 also includes one or more support members 112. The support member 112 provides the structural means for supporting the work surface 96. The support member 112 may also provide support for additional elements, such as cabinetry partitions, screens, shelves, returns, drawers, and the like, either by direct connection to the support member 112 or indirectly by connection to another intermediate element, such as the work surface 96, which is in turn connected to the support member 112.

In this embodiment, the support member 112 comprises vertical solid panels 120, 122, and 124. The support member 112 may also include one or more panel returns 125 located at the ends of the work surface 96. The vertical solid panels may connect to the horizontal work surface 96 at a rear edge 130 thereof. Specifically, panel 120 connects to a rear edge 132 of surface section 100, panel 122 connects to a rear edge 134 of surface section 102, and panel 124 connects to a rear edge 136 of surface section 104. The panels may extend vertically only to the height of the work surface 96 (e.g. panels 122 and 124) and connect to the work surface 96 thereat or may extend vertically above an upper surface of the horizontal work surface 96 (e.g. panel 120) to provide for privacy between work stations, to provide support for cabinetry or shelving, or for other purposes. In addition, the one or more returns 125 may connect ends of the work surface 96 to a vertical solid panel.

In a preferred embodiment, the support member 112 may further comprise glides 138 that preferably connect to a bottom edge of the panels 120, 122 and 124. Glides 138 facilitate positioning and moving the work station 90 and also facilitate the distribution of cabling into, out of, between and among work station modules, as explained below.

As mentioned above, prior office work station systems have employed partition walls that have been adapted to include cables to distribute power, communications and data. Other prior systems included channels enclosed within desks, cabinets and the like. In the present embodiment, the work station 80 provides for the distribution of cabling by means of a first trough 150 and a second trough 152. The first trough (also referred to as the upper trough) 150 and the second trough (also referred to as the lower trough) 152 are positioned and aligned in the work station module 80 to distribute cabling for power, communications, and data into, through, between, and among the work stations, as explained below.

In the embodiment shown in FIG. 2, the upper and lower troughs 150 and 152 are attached to the support member 112 beneath the horizontal work surface 96. The upper trough 150 is connected to the support member 112 at a location above the lower trough 152.

In the preferred embodiment, the upper trough 150 may comprise three segments 154, 156, and 158 connected to the three vertical support panels 120, 122, and 124 respectively. Also, the lower trough 152 may comprise three segments 160, 162, and 164 connected to the three vertical support panels 120, 122, and 124 respectively. In this embodiment, each segment of each trough within the work station is a linear section and extends horizontally substantially to the segment of trough adjacent to it within the module. There may be a small space or gap between trough segments horizontally, such as gap 170 between lower trough segments 160 and 162 and gap 172 between lower trough segments 162 and 164. The upper trough segments may be similarly constructed having gaps 174 and 176 separating upper trough segments 154 and 156, and 156 and 158, respectively.

In a preferred embodiment, the work station 80 is provided with troughs not only along the side thereof that corresponds to the closed side of the work station (e.g. sides 38, 40, 42, and 44, of FIG. 1 but also along other sides (e.g. which may correspond to the orthogonal sides 54, 56, 58, 60, 62, 66, and 68 of FIG. 1 as well as along the angled sides that connects the closed sides to the orthogonal sides). Troughs located on these sides provide for the distribution of cabling to not only adjacent work stations along the closed side, but also to locations on the work surface segments such as 100 and 102. This may be done to minimize the lengths of cabling located on top of the work surface by concealing the cabling under the work surface in a trough. In addition, by including a trough along both segment 100 and segment 102, the work station can be utilized in a configuration with either segment 100 or segment 102 serving as the closed side parallel to the aisle thus providing a substantial degree of design flexibility.

In a preferred embodiment, the upper trough 150 is used primarily for telecommunications and data cabling. This would typically include ordinary telephone lines, twisted pair, shielded cable, and the like. The lower trough 152 is used primarily for electrical cabling. This would include typically flexible metal armored cable 177, depicted in FIG. 2. Although the upper trough 150 is primarily for data and communications, electrical cables may also be included in the upper trough 150. Likewise, although the lower trough 152 is primarily for electrical cabling, it may also include data and telecommunications cabling as well. Some building codes or ordinances provide specific restrictions or requirements regarding which type of cables can be positioned in proximity to each other or can share a single channel or raceway. For example, it may be prohibited to put electrical cabling and telephone cabling in proximity in the same channel. Where such codes or ordinances exist, the described embodiment of the present invention can readily provide for the necessary and appropriate separation between different types of cabling by placement in separate troughs.

In a preferred embodiment, the upper trough 150 is comprised of a metal that also serves to provide electromagnetic shielding of the cables located therein from the cabling in the lower trough 152. Thus, by reason of its geometry and location as well as its composition, the upper trough 150 can provide for substantial shielding from electromagnetic interference from electrical transmission lines in the lower trough 152. The upper trough 150 may be grounded to enhance this shielding effect. The lower trough 152 may be comprised of a material that provides for electromagnetic shielding as well.

The work surface 96 may include one or more passageways 178 therethrough to permit cabling to pass from the troughs located beneath the work surface 96 to an upper side of the work surface for use with office equipment including telephones, computers, printers, and the like. In this embodiment, the passageway 178 is formed by gap between a portion of the rear edge a work surface segment, e.g. 104, and the vertical panel 124.

Figure 3:
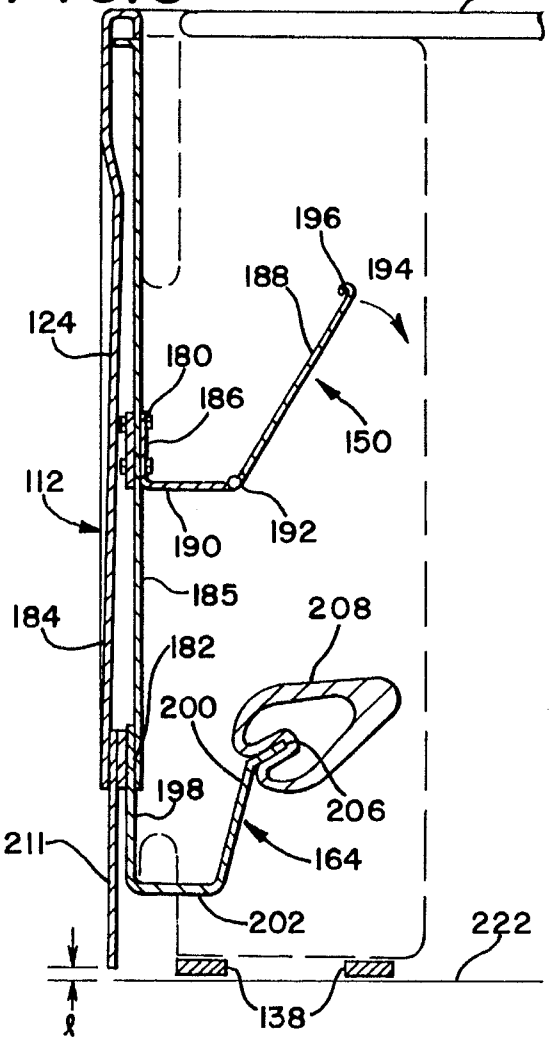
FIG. 3 is a vertical sectional view of a portion of the embodiment depicted in FIG. 2 through lines 3—3'.

Referring to FIG. 3, there is a vertical sectional view of a portion of the support member 112 showing the upper and lower troughs 150 and 152, respectively. It should be understood that this section of the support member 122 may be representative of the adjacent sections and that the features described pertain to the adjacent sections as well.

As mentioned above, the upper trough 150 is connected to the support member 112 and in particular to the vertical panel 124 beneath the level of the work surface 96. The lower trough 152 is also connected to the vertical panel 124 but at a location below the upper trough 150. The connection between the troughs 150 and 152 and the vertical panel 124 may be by any suitable means, such as fasteners 180, which may be nut and bolt combinations, or by sandwiching a portion 182 of the trough between layers 184 and 185 of the vertical panel 124. In the embodiment depicted in FIG. 3, both these types of connection are represented. The upper trough 150 employs the fastener 180 (e.g. nut and bolt) connection and the lower trough 152 has a portion 182 thereof connected between layers 185 and 184 of the vertical panel 124 in a sandwich arrangement. Other types of connection means may be employed and are contemplated within the scope of the present embodiment.

Both the upper and lower troughs possess a U-shape contour or cross-sectional profile with a rear side, a front side and a bottom side connecting the rear and front sides. Upper sides of each trough are open to enable the direct laying-in of cable, wiring and the like.

The upper trough 150 has a rear side 186 that is adjacent to the vertical panel 124 and connected thereto, as described above. The upper trough 150 also includes a front side 188 and a bottom side 190. The front side 188 of the upper 150 trough is connected to the bottom side 190 with a hinge joint 192 to enable the front side 188 to swing vertically downward (in the direction of the arrow 194) to facilitate access into the upper trough 150. The upper trough 150 is preferably formed of a pressed sheet of metal. The front side 188 of the upper trough 150 includes an upper lip 196 which in the preferred embodiment is rolled to provide a rounded edge.

The lower trough 152 has a rear side 198 that coincides with the vertical panel 124 and is connected thereto, as described above. The lower trough 152 also has a front side 200 and a bottom side 202. The connection between the front side 200 of the lower trough 152 and the bottom side 202 need not include a hinge joint because its lower position is not likely to present any problem of access to the interior of the lower trough 152. The lower trough 152 is also preferably comprised of a pressed sheet of metal. In the preferred embodiment, an upper edge 206 of the front side 200 of the lower trough 152 includes a rolled member 208 connected thereto. This rolled member 208 may be a plastic or rubber tube or roll and attached to the upper edge 206 of the front side 200 of the lower trough 152 by a friction fit or an adhesive or the like. The rolled member 208 is positioned to serve as a foot rest for a worker at the work station.

Figure 4:
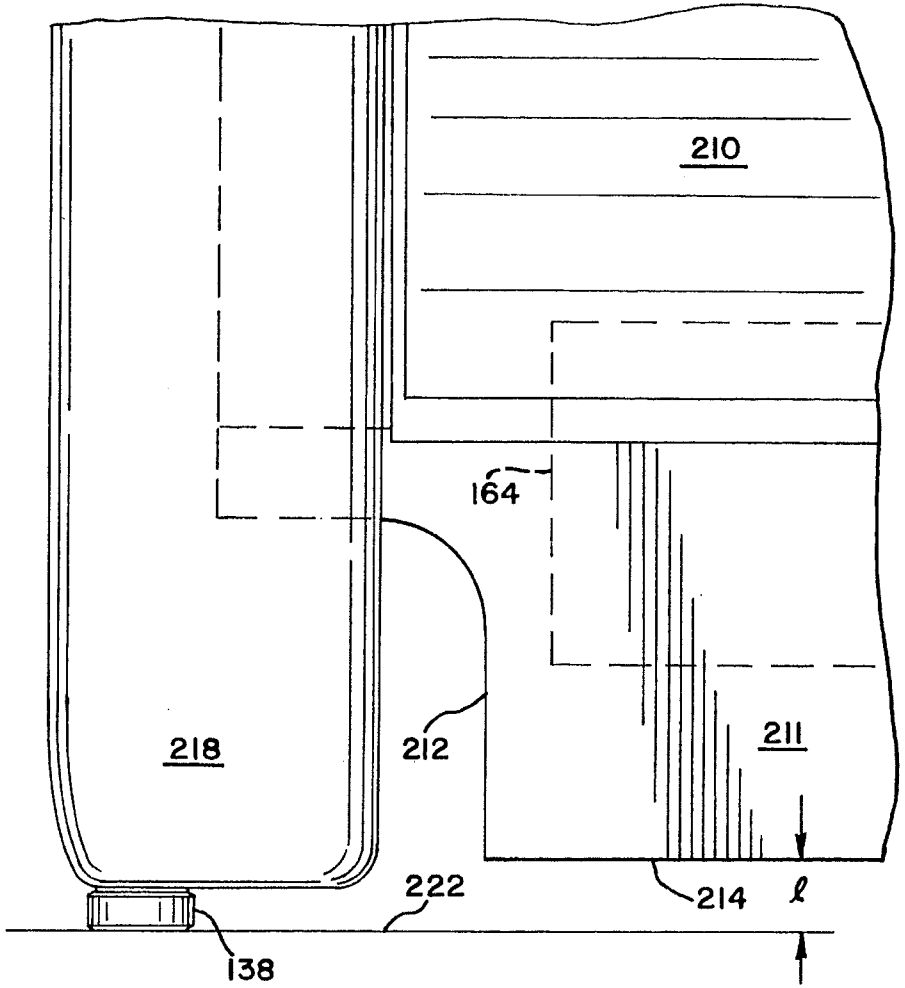
FIG. 4 is a plan view of a portion of the embodiment depicted in FIG. 2.

In a preferred embodiment, the work station 80 is comprised so that cabling located in the upper or lower troughs 150 and 152 can extend relatively easily between adjacent work stations. To facilitate passing cables between adjacent work stations, the vertical panel 124 further includes a rigid panel 210 section to which is connected a movable strip member 211 located along a bottom edge thereof. This movable strip 211 may be made of a resilient, flexible plastic so that the bottom edge of the strip can be readily bent or moved to allow the feed through of cabling underneath the vertical panel. In an alternative embodiment, the movable strip 211 is formed of a rigid material but is hinged at an upper edge thereof to a bottom edge of the vertical panel. Preferably, a hinge is used that allows movement of the strip in both directions, i.e. both in the direction underneath the work surface and in the opposite direction. Pass through of cabling from one work station to another may be further facilitated by one or more access ways or apertures 212 located adjacent to the troughs. The access way 212 may be formed in an end of the movable member 211, as shown in FIG. 4.

In a preferred embodiment, the access way 212 is located at and opens to a bottom edge 214 of a vertical panel 124, and in particular at the bottom edge of the movable member 211. The vertical panel 124 may also include a vertical leg 218 and the glide 138 connected to the vertical leg 218. Both the leg 218 and the glide 138 are sized and positioned with respect to the panel section 210 and the movable member 211 of the vertical panel 124 so that the bottom edge 214 of the panel section 124 is spaced above the floor 222 and a clearance '1' is provided between the bottom edge 214 of the vertical panel 124 and the floor 222. In a preferred embodiment, this clearance, 1, is approximately 1 inch. This clearance '1' and the access way 212 provide that cabling from the upper or lower troughs 150 and 152 may pass from the side of the work station 80 underneath the horizontal work surface 96 where the troughs are located to the other side of the panel 124 to run to adjacent work stations or other components. In a preferred embodiment access ways are located at each lower corner of each vertical panel 120, 122, and 124.

According to this embodiment, cabling may be located in upper or lower troughs located along the side of the work station parallel to the closed side so that cabling may be run along the row of work stations. Some of the cabling may be used by the work station in which it is located but some of it will likely pass through the work station to provide electrical, data, or communications service to another work station located along the row of work stations, such as depicted in FIG. 2. This can readily be provided because the troughs may be supplied with ample volume or capacity to convey not only the cabling needs of a single work station but the needs of a number of work stations.

As described above, the aperture 212 is located so as to open to the bottom edge 214 of the vertical panel 124. This provides the advantage that the work station 80 can be readily lifted as a whole and relocated without the necessity for disconnecting cabling or complicated and costly rewiring. According to this feature, the cabling which passes through the troughs of the work station in order to connect to adjacent or more distant work stations is laid in the trough with sufficient slack so that it can be lifted up out of the trough over the edge of the front side thereof and laid on the floor with the work station still in place. The work station can then be lifted and removed leaving the cabling on the floor without the need to disconnect the cabling. This is made possible because the access ways (or apertures) adjacent the troughs are open to the bottom edge of the work station. Thus, no barrier exists to removing the cabling from the trough without disconnecting it. This provides for so-called "lay-in" wiring. After the cabling for adjacent work stations is located out of the troughs and on the floor, the work station as a whole may be lifted, by a wheeled jack or other means, and moved to another location. Another work station can be relocated into the position from which the prior work station was previously removed and the cabling lifted into position into the trough of the new work station.

Relocation of the work station is also facilitated by a preferred construction in which the vertical panels 120, 122, and 124 are all interconnected to form a single unitary support member 112. Relocation is further facilitated by the clearance '1' provided between the bottom of the panel section 216 and the floor 222. This clearance '1' enables relocation and rerouting of cabling even without relocation of the work station and also provides a location at which the jack can be positioned in order to lift the work station.

It is intended that the foregoing detailed description be regarded as illustrated rather than limiting and that it is understood that the following claims including all equivalents are intended to define the scope of the invention.

We claim:

1. A work station module for an office area comprising:

a horizontal work surface having a front edge and a rear edge, a support member for standing on a floor of the office area and connected to and supporting said horizontal work surface above the floor, said support member having a lower edge, and further in which said support member comprises one or more substantially flat planar vertical panels having a bottom edge and a top edge connected to said horizontal work surface;

a means for facilitating passage of cabling connected to the bottom edge of said one or more substantially flat planar vertical panels and movable in relation to the bottom edge to allow passage of cabling under the bottom edge;

a first trough located in an area beneath said horizontal work surface and defining a substantially horizontal passageway for the laying in of cabling; and a second trough defining a second substantially horizontal passageway, said second trough at a location displaced vertically below said first trough whereby said first and said second troughs define separate substantially horizontal passageways for cabling and communicate with an access way through the support member to enable cabling to pass from said first and said second troughs from an area beneath said work surface to an area outside thereof, said access way open to the lower edge of the support member whereby a work station module can be lifted and removed without disconnection of cabling extending through said first and said second troughs.

2. The work station module of claim 1 in which said facilitating means is comprised of a flexible resilient material.

3. The work station module of claim 1 in which said facilitating means is hinged at an upper edge thereof to said one or more vertical panels.

4. A work station module for an office area comprising:

a horizontal work surface having a front edge and a rear edge, a support member for standing on a floor of the office area and connected to and supporting said horizontal work surface above the floor, said support member having a lower edge, and further in which said support member comprises one or more substantially flat planar vertical panels having a bottom edge and a top edge, and in which said support member is aligned with said rear edge of said horizontal work surface;

a trough located in an area beneath said horizontal work surface and connected to and supported by the support member and defining a substantially horizontal passageway for the laying in of cabling, and further in which said trough is connected to said support member on a first side thereof facing the front edge of said horizontal work surface, and further in which the support member defines an aperture to provide an access way in the direction of the trough to enable cabling to pass from said trough in an area beneath said work surface to an area outside thereof, said access way open to the lower edge of the support member whereby a work station module can be lifted and removed without disconnection of cabling extending through said trough;

one or more glides connected to said one or more vertical panels and extending downward from said bottom edge thereof to define a space between said bottom edge and a floor below whereby repositioning of said work station module is facilitated; and a means for facilitating passage of cabling, said facilitating means connected to the bottom edge of said one or more substantially flat planar vertical panels and movable in relation to the bottom edge to allow passage of cabling under the bottom edge.

5. The work station module of claim 4 in which said facilitating means is comprised of a flexible resilient material.

6. The work station module of claim 5 in which said facilitating means is hinged at an upper edge thereof to said one or more vertical panels.

* * * * *

UNITED STATES PATENT AND TRADEMARK OFFICE

CERTIFICATE OF CORRECTION

PATENT NO. : 5,473,994

DATED : December 12, 1995

INVENTOR(S) : Dennis Foley et al.

It is certified that error appears in the above-indentified patent and that said Letters Patent is hereby corrected as shown below:

On the Title Page, item [56],

In column 1, line 4 under "References Cited U.S. PATENT DOCUMENTS", delete "5/1998" and substitute --8/1990--.

Signed and Sealed this

Twenty-ninth Day of October 1996

*Attest:*

Bruce Lehman

BRUCE LEHMAN

*Attesting Officer*

*Commissioner of Patents and Trademarks*